US005366044A

United States Patent [19]

Jamieson et al.

[11] Patent Number: 5,366,044

[45] Date of Patent: Nov. 22, 1994

[54] BIDIRECTIONAL EDDY CURRENT OVERSPEED PROTECTION FOR ELEVATORS

[75] Inventors: Eric K. Jamieson, Farmington; Young S. Yoo, Avon; Breffni X. Baggot, New Britain, all of Conn.

[73] Assignee: Otis Elevator Company, Farmington, Conn.

[21] Appl. No.: 84,045

[22] Filed: Jun. 28, 1993

Related U.S. Application Data

[63] Continuation-in-part of Ser. No. 965,477, Jun. 3, 1991.

[51] Int. Cl.[5] ..... B66B 5/16

[52] U.S. Cl. ..... 187/359; 187/108; 188/161

[58] Field of Search ..... 187/89, 90, 91, 32, 187/33, 34, 88, 73, 108, 109; 188/161, 164, 165, 155, 156

[56] References Cited

U.S. PATENT DOCUMENTS 5,154,261 10/1992 Tanaka et al. ..... 188/161

FOREIGN PATENT DOCUMENTS 498597 8/1992 European Pat. Off. ..... 187/108

51040 3/1982 Japan ..... 188/161

*Primary Examiner*—Kenneth W. Noland

[57] ABSTRACT

A magnet 34 is mounted to a linkage 30 which passes vertically over a conductive vane 32 which extends the entire length of the elevator hoistway 46. Eddy currents induced in the conductive vane 32 as the magnet 34 passes over the conductive vane 32 cause a reaction force on the magnet 34 and the linkage 30. The reaction force causes the safety 26 or 28 to contact a guide rail 22 on which an elevator car 10 is riding, thereby braking the elevator car 10 at any point in the hoistway between the terminals and eliminating the need for a governor. The vane width 50 is large at the terminals as compared to the middle of the hoistway 46 which increases the reaction force at the terminals. The invention eliminates the need for a governor.

7 Claims, 4 Drawing Sheets

BIDIRECTIONAL EDDY CURRENT OVERSPEED PROTECTION FOR ELEVATORS

The present invention is a continuation-in-part of U.S. patent application Ser. No. 07/965,477, now U.S. Pat. No. 5,301,773.

TECHNICAL FIELD

This invention relates to arresting movement of an elevator car at any vertical position in an elevator hoistway between terminal landings.

BACKGROUND OF THE INVENTION

Elevators are presently provided with a plurality of braking devices. In normal operation, the brakes hold the elevator car in place where it stops at a landing. In emergency situations, the brakes may stop the elevator car from plunging into the hoistway pit.

One known braking device for emergency motion is a governor triggered braking device. The governor triggered braking device comprises a governor, a governor sheave assembly, at least one safety, and a governor rope.

The governor is a mechanical speed control which monitors the speed of the elevator car; a centrifugal force means is used for detecting the overspeeding elevator car.

The governor sheave assembly comprises a governor sheave at the top of the hoistway and a tension sheave at the bottom of the hoistway which guide the governor rope and keep tension on it.

The safety is a mechanical device attached to the elevator car frame employed to stop and hold the elevator car in case of predetermined overspeed or free fall. The governor triggered braking device operates as follows.

The governor rope is looped over the governor sheave at the top of the hoistway and the tension sheave at the bottom of the hoistway and is attached to the elevator car. As the governor rope exceeds the rated speed of the elevator car by a limit, the governor grabs the governor rope which pulls on a linkage attached to the elevator car, thereby triggering one or more safeties. This brakes the elevator car.

Elimination of the governor braking device would reduce the amount of machine room and pit equipment which in turn would reduce installation and maintenance costs.

DISCLOSURE OF THE INVENTION

Objects of the present invention include providing overspeed protection for an elevator car traveling in the up or down direction at any position in the hoistway, which requires no electrical power, no buffer, and no governor.

According to the present invention, for braking at any point in a hoistway an elevator which has exceeded a speed threshold, a conductive vane extends the length of the hoistway such that a magnet mounted on the elevator induces an eddy current in the conductive vane which in turn produces an electromagnetic reaction force on the magnet, causing the magnet to actuate a brake, thereby braking the elevator car at any vertical point between the hoistway terminals. Thus, the need for a governor is eliminated.

A widened vane is provided at the terminals to increase the reaction force at the terminals as compared to the reaction force provided in the middle of the hoistway, assuming the same elevator velocity at the middle of the hoistway and at the terminals. This decreases the speed threshold required to actuate the brake. The decreased speed threshold at the terminals eliminates the need for a buffer. Alternatively, the widened conductive vane at both terminals is replaced with a first vertical conductive vane with uniform cross section and a second conductive vane such that a second magnet assembly passes over the second vane. The second conductive vane cooperates with the second magnet to provide an increased reaction force at the terminals as compared to the reaction force provided in the middle of the hoistway, assuming the same elevator velocity at the middle of the hoistway and at the terminals.

Among the advantages of the present invention are: (1) non-contact operation, eliminating governor rope wear, (2) bidirectional operation of the safeties from a single triggering device, (3) no speed contacts to adjust during installation, (4) no pit or machine equipment to install thus reducing installation and maintenance costs.

The foregoing and other objects, features and advantages of the present invention will become more apparent in light of the following detailed description and accompanying drawings.

BEST MODE FOR CARRYING OUT THE INVENTION

Figure 1:
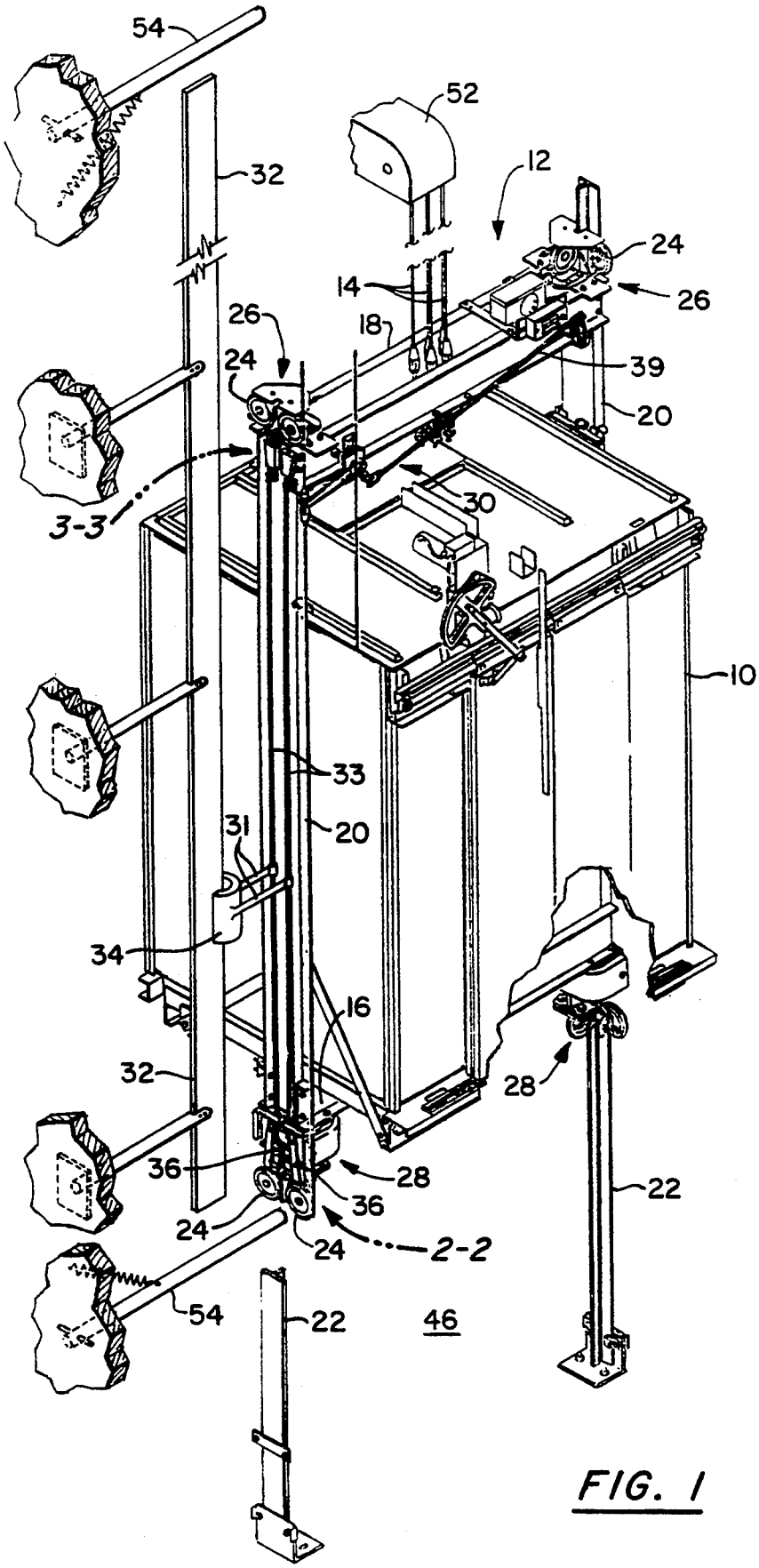
FIG. 1 is a perspective view of an elevator system employing the present invention.

In FIG. 1, an elevator car 10 sitting in a car frame 12 which hangs from ropes 14 is shown. The car frame 12 includes a safety plank 16 on which the elevator car 10 sits, a crosshead 18, and two uprights 20, one on either side of the elevator car 10. On either side of the car frame 12 is a guide rail 22 on which the car frame 12 rides by means of roller guides 24.

Figure 5:
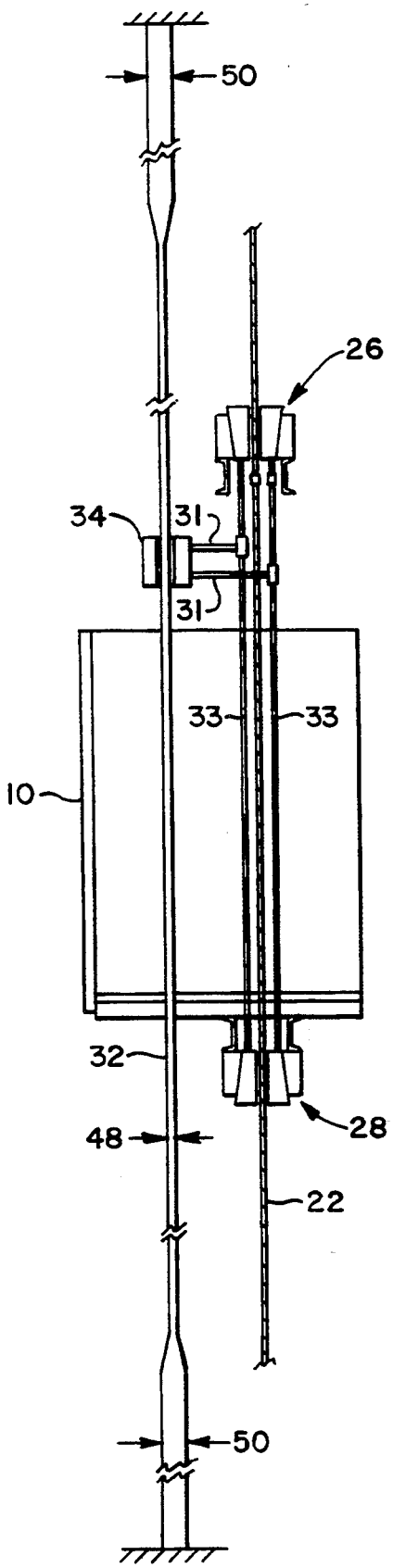
FIG. 5 is a side view of the elevator system of FIG. 1.

Referring to FIGS. 1 and 5, a bidirectional eddy current brake device comprises upper wedge safeties 26, lower wedge safeties 28, a linkage 30 (shown in detail in FIG. 3), a conductive vane 32, and a magnet 34.

Figure 2:
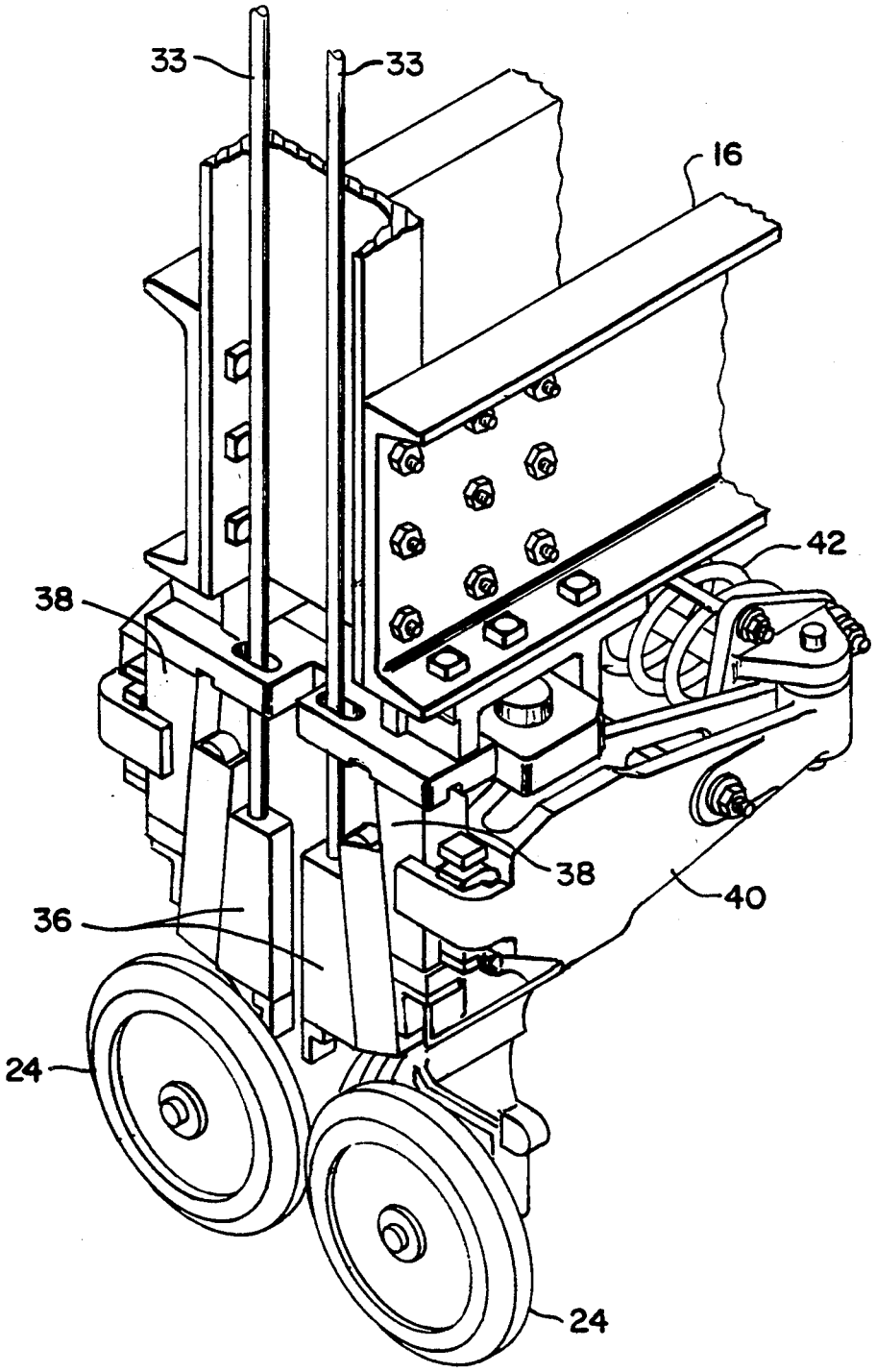
FIG. 2 is a magnified perspective view of a wedge safety shown in FIG. 1 of an area 2—2.

In FIGS. 1, 2 and 5, the upper and lower wedge safeties 26 and 28 are mechanical devices attached to the elevator car frame 12 employed to stop and hold an overspeeding elevator car 10 moving in the up or down directions.

FIG. 2 shows a wedge safety 28. Each wedge 36 is secured to the safety rods 33 to sit within wedge guides 38 which are tapered such that if the magnet 34 pulls the safety rods 33, then the safety rods 33 pulls the wedges 36 vertically, deep into the wedge guides 38, so that the wedges 36 pinch the guide rail 22. The friction generated by the initial contact with the guide rail 22 produces an additional force, further urging the wedges 36 between the wedge guides 38 and guide rail 22, producing an increasing pinching force on the guide rail 22.

The increasing pinching force on the guide rail 22 is limited when the wedges 36 push outwardly on pivot arms 40 against the force of a compression spring 42. The compression spring 42 controls the maximum pinching force to produce a progressive deceleration of the elevator car 10.

Referring to FIGS. 1 and 2, for a down direction run, if the safeties are triggered, the wedges 36 on the wedge safeties 28 below the elevator car 10 will be lifted by the safety rods 33 so as to contact the guide rail 22 whereas the wedges 36 on the wedge safeties 26 above the elevator car 10 are lifted away from the guide rail 22. For an up direction run, the movement of the wedges 36 is downward when the top wedge safeties 26 are activated. Thus, the braking action is effective whether the safety rods 33 are moved up or down. It should be understood by those skilled in the art that the above-mentioned safeties have various configurations including wedge safeties, and roller safeties.

Figure 3:
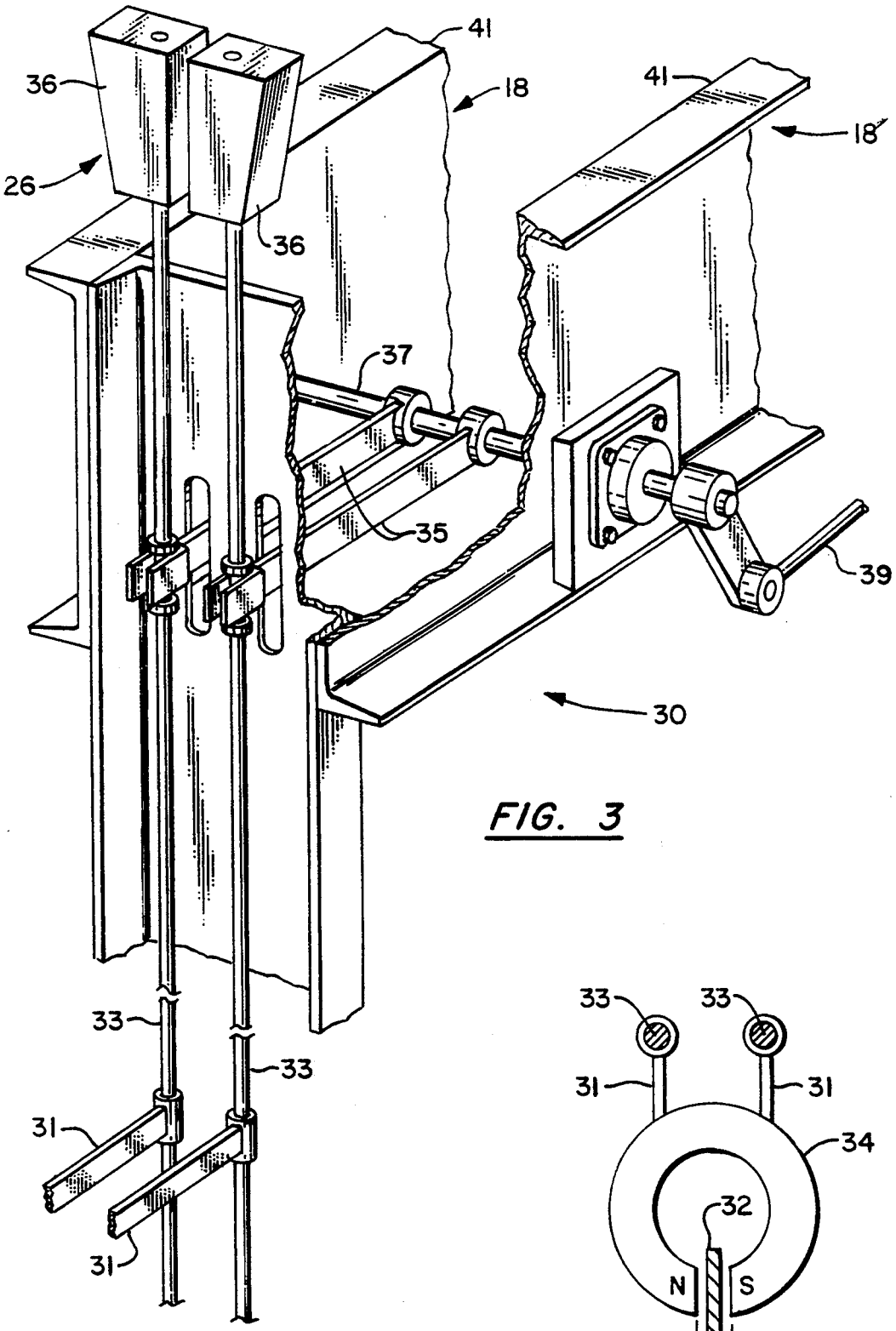
FIG. 3 is a magnified perspective view of a linkage shown in FIG. 1 of an area 3—3.

In FIGS. 1 and 3, a linkage 30 is used to connect the upper safeties 26 and lower safeties 28 on both sides of the elevator car 10 to a magnet 34 such that vertical movement of the magnet 34 relative to the elevator car 10 will trigger the safeties 26 or 28 to brake the elevator car 10. The linkage 30 comprises magnet rods 31, safety rods 33, connecting rods 35, an inner safety operating lever 37 and a safety linkage 39.

In FIG. 3, the magnet rods 31 connect a magnet 34 (shown in detail in FIG. 4) to the safety rods 33. Vertical motion of the safety rods 33 cause motion of the connecting rods 35 which produces rotation of the inner safety operating lever 37 disposed between beams 41 of the crosshead 18. Rotation of the inner safety operating lever 37 produces motion of the safety linkage 39 which in turn causes simultaneous actuation of the safety rods 33 on both the left and right sides of the elevator car 10.

Figure 4:
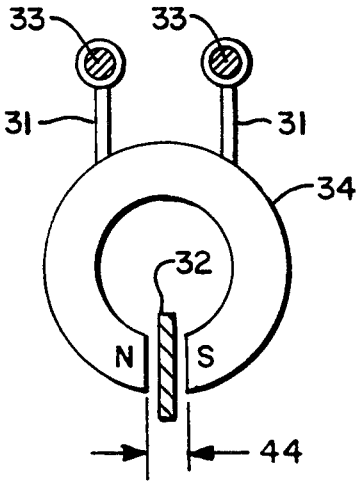
FIG. 4 is a top sectional view of a conductive vane in an air gap of a permanent magnet shown in FIG. 1.

In FIG. 4, the magnet 34 is connected by the magnet rods 31 to the safety rods 33 which are connected to the upper and lower safeties 26 and 28 (shown in FIG. 1). The magnet 34 is positioned such that as the magnet 34 moves along a conductive vane 32 a predetermined air gap 44 exists between the magnet 34 and the conductive vane 32.

Referring to FIGS. 1 and 5, a conductive vane 32 is disposed vertically along the entire length of the hoistway 46 so that a conductive medium is provided for the operation of the eddy current brake device which functions as follows.

As the magnet 34 moves over the conductive vane 32 in the hoistway 46, an eddy current is induced in the conductive vane 32 causing a reaction force to prevent the motion of the magnet 34, and the safety rods 33 connected to it, from passing over the conductive vane 32. Therefore, if the elevator car 10 is moving in the down direction, the reactive force acts in the up direction. If the elevator car 10 is moving in the up direction, the reactive force acts in the down direction. Moreover, the reaction force increases as the elevator car 10 speed increases.

When the reactive force acts the magnet 34, the safety rods 33 move vertically and trigger the wedge safety 26 or 28. Once triggered, the wedge safety 26 or 28 contacts the rail guide 22 and causes the elevator car 10 to be braked. The braking action is effective whether the safety rods 33 are moved up or down. Since the bidirectional eddy current brake device does not require electric power, positive stopping can be provided at all times.

FIG. 5 shows a side view of the elevator car 10. The conductive vane width 48 in the middle of the hoistway 46 is such that the safeties 26 or 28 will be triggered due to the eddy current reaction force on the magnet 34, thus braking the elevator car 10, when the elevator car 10 is traveling above 115% of contract velocity in either the upward or downward direction.

The vane width 50 at the terminals is widened such that the reaction forced is increased at the terminals; thus, causing the magnet 34 and the linkage 30 to actuate the wedge safeties 26 or 28 at a lower velocity limit as compared to the velocity limit in the middle of the hoistway where the vane width 48 is narrower. Below this velocity limit, the reactive force is insufficient to cause the magnet 34 and the linkage 30 to actuate the wedge safeties 26 or 28 and therefore on a normal-speed run into a terminal the elevator car 10 is stopped by normal braking of a sheave 52 in a known manner.

It should be understood by those skilled in the art that the increase in the reaction force at the terminals also may be achieved by other various methods such as changing the dimensions of the magnet 34 in relation to the conductive vane 32 or by changing the dimensions of the conductive vane 32 with respect to the magnet 34.

In FIG. 1, spring-based cams 54 are employed as a terminal braking device for the elevator car 10. Should the elevator car fail to stop beyond its normal range while traveling too slowly to cause braking by means of the eddy current brake device, one of the spring-biased cams 54, at the bottom of the hoistway 46 or at the top of the hoistway 46, actuates the wedge safeties 26 or 28 when it contacts the linkage 30. Similar to the case of the eddy current brake device, the safety rods 33 are caused to move vertically, bringing the wedges 36 into contact with the guide rails 22 for braking the elevator car 10.

Figure 6:
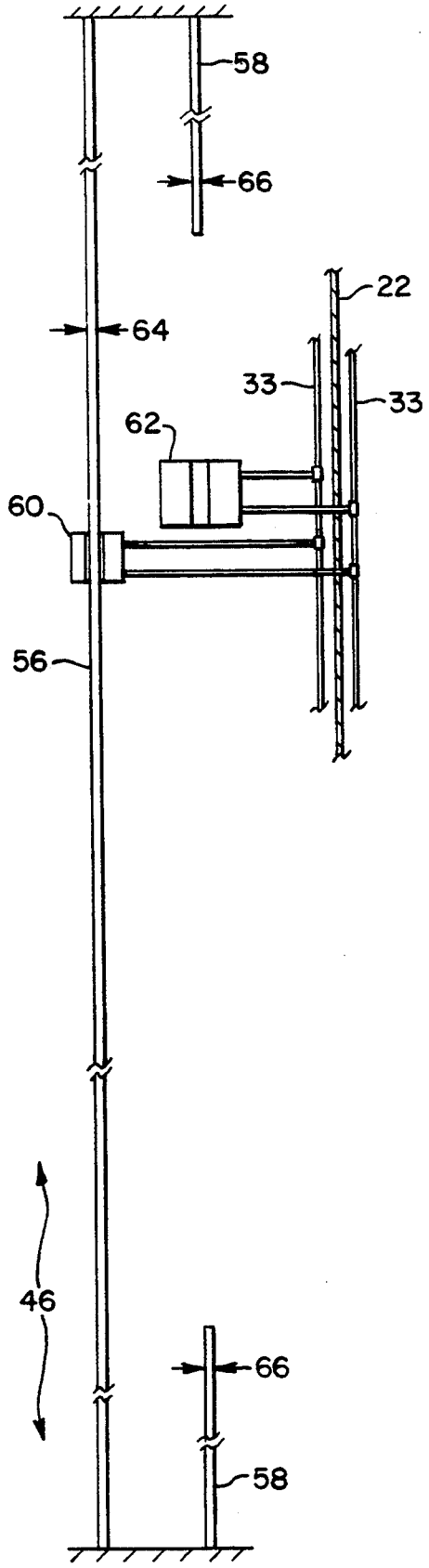
FIG. 6 is a side view of an alternate eddy current brake system for use in the elevator system of FIG. 1.

Shown in FIG. 6 is an alternate embodiment which replaces the single conductive vane 32 with a first conductive vane 56 and a second conductive vane 58 each having a uniform width. The first conductive vane 56 is disposed vertically along the entire length of the hoistway 46. The second conductive vane 58 is disposed vertically at each terminal extending a limited distance toward the center of the hoistway 46. Additionally, the single magnet 34 is replaced by a first magnet assembly 60 which passes over the first conductive vane 56 and a second magnet assembly 62 with different flux density which passes over the second conductive vane 58.

The vane width 64 of the first conductive vane 56 is such that the eddy current reaction force on the first magnet assembly 60 will actuate the safeties 26 or 28, thus braking the elevator car 10 in a manner described above, when the elevator is traveling above 115% of contract velocity in either the upward or downward direction.

The vane width 66 of the second conductive vane 58 is such that the resulting reaction force will cause the second magnet assembly 62 to actuate the safeties 26 or 28, thus braking the elevator car 10 in a manner described above, at a lower velocity as compared with the first magnet assembly 60.

Selection of the magnet size and plate size depends on the air gap, plate conductivity selected, reaction force selected and the speed threshold at which the brake is actuated.

Although the invention has been shown and described with respect to a best mode embodiment thereof, it should be understood by those skilled in the art that various other changes, omissions and additions in the form and detail thereof may be made therein without departing from the spirit and scope of the invention.

We claim:

1. A device for exerting a braking force on an elevator guide rail to brake the movement of an elevator car without the use of a governor, comprising:

(a) at least one safety for contacting said elevator guide rail and producing said braking action;

(b) a magnet disposed on said elevator car; and (c) a conductive vane disposed vertically along the entire length of a hoistway such that as said magnet moves along said conductive vane a current is induced in said conductive vane in a direction so as to generate a magnetic field to oppose a changing field that induced said current so that said magnet causes said safety to contact said elevator guide rail and exert said braking force on said elevator guide rail, wherein the device may exert said braking force at any point along the said hoistway.

2. A device for exerting a brake force on an elevator guide rail to brake the movement of an elevator car without the use of a governor as recited in claim 1, further comprising a linkage for connecting said safety to said magnet such that vertical movement of said magnet triggers said safety to exert said braking force upon said elevator guide rail.

3. A device for exerting a brake force on an elevator guide rail to brake the movement of an elevator car without the use of a governor as recited in claim 1, further comprising:

(a) a second magnet such that vertical movement of said second magnet triggers said safety to exert said braking force upon said elevator guide rail; and (c) a second conductive vane disposed vertically in said hoistway such that as said second magnet moves along said second conductive vane a second current is induced in said second conductive vane in a direction so as to generate a second magnetic field to oppose a second changing field that induced said second current so that said second magnet causes said safety to contact said elevator guide rail and exert said braking force on the said elevator guide rail.

4. A device for exerting a braking force on an elevator guide rail to brake the movement of an elevator car without the use of a governor as recited in claim 1, wherein the width of said conductive vane is increased near the upper terminal floor and the lower terminal floor of said hoistway, as compared to the width of said conductive vane substantially in the middle of the hoistway.

5. A device for exerting a braking force on an elevator guide rail to brake the movement of an elevator car without the use of a governor as recited in claim 1, further comprising a cam responsive to contact with said elevator car for causing said safety to contact said elevator guide rail.

6. A device for exerting a braking force on an elevator guide rail to brake the movement of an elevator car without the use of a governor as recited in claim 1, wherein a widened vane is provided at the terminals, as compared to the width of said conductive vane substantially in the middle of the hoistway, to increase the reaction force at the terminals as compared to the reaction force provided substantially in the middle of the hoistway, and a cam responsive to contact with said elevator car for causing said safety to contact said elevator guide rail is disposed in said hoistway.

7. A method for braking an elevator car at any point in an elevator hoistway without the use of a governor, which comprises the steps of:

(a) providing a magnet disposed on said elevator car;

(b) providing a conductive vane disposed vertically in said hoistway;

(c) moving said magnet over said conductive vane for producing an electromagnetic reaction force;

(d) providing a braking force in response to said electromagnetic reaction force for braking said elevator car.

* * * * *